US006676584B2

(12) United States Patent
Tachikawa et al.

(10) Patent No.: US 6,676,584 B2
(45) Date of Patent: Jan. 13, 2004

(54) PACKAGING AND ASSEMBLYING METHOD THEREOF

(75) Inventors: Kimiko Tachikawa, Tokyo (JP); Daisuke Tamezumi, Tokyo (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 36 days.

(21) Appl. No.: 09/892,910

(22) Filed: Jun. 28, 2001

(65) Prior Publication Data

US 2002/0037795 A1 Mar. 28, 2002

(30) Foreign Application Priority Data

Sep. 28, 2000 (JP) ..... 2000-297251
Dec. 26, 2000 (JP) ..... 2000-395008

(51) Int. Cl.[7] ..... B31B 1/48; B31B 13/14; B65D 73/00; B65D 85/38

(52) U.S. Cl. ..... 493/70; 493/86; 206/461; 206/462; 206/316.2

(58) Field of Search ..... 206/461, 462, 206/493, 463, 703, 705, 316.2; 493/468, 70, 114, 189, 160, 86

(56) References Cited

U.S. PATENT DOCUMENTS

| | | | | | |
|---|---|---|---|---|---|
| 1,011,697 | A | * | 12/1911 | Witkowski | 206/463 |
| 3,246,747 | A | * | 4/1966 | Blish | 206/462 |
| 3,587,848 | A | * | 6/1971 | Froehlig | 206/462 |
| 3,776,375 | A | * | 12/1973 | Rohdin | 206/463 |
| 4,261,462 | A | * | 4/1981 | Wysocki | 206/462 |
| 4,485,920 | A | * | 12/1984 | Skylvik | 206/461 |
| 4,842,141 | A | * | 6/1989 | Segal | 206/462 |
| 4,951,404 | A | * | 8/1990 | Lithwick | 206/462 |
| 5,119,952 | A | * | 6/1992 | Warriner, Jr. | 206/462 |
| 5,297,679 | A | * | 3/1994 | Rondone et al. | 206/461 |
| 5,607,101 | A | * | 3/1997 | Saito | 206/462 |
| 6,050,415 | A | * | 4/2000 | Lind et al. | 206/462 |
| 6,230,964 | B1 | * | 5/2001 | Saito | 206/462 |
| 6,308,832 | B1 | * | 10/2001 | Pirro et al. | 206/462 |

* cited by examiner

*Primary Examiner*—Anthony D. Stashick
(74) *Attorney, Agent, or Firm*—Sughrue Mion, PLLC

(57) ABSTRACT

A paper packaging accommodating a product that includes a support member having an opening; a box section protruding through said opening from a back side to a front side of said support member; and a backing sheet covering said back side of said support member.

30 Claims, 8 Drawing Sheets

PACKAGING AND ASSEMBLYING METHOD THEREOF

This patent application claims priority from Japanese patent applications Nos. 2000-297251 filed on Sep. 28, 2000 and 2000-395008 filed on Dec. 26, 2000, the contents of which are incorporated herein by reference.

BACKGROUND OF THE INVENTION

1. Field of the Invention

The present invention relates to a paper packaging. The present invention, in particular, relates to a blister packaging.

2. Description of the Related Art

A blister packaging is popular for accommodating a product such as a shaver, a battery, a toy, and so on. A box section accommodating the product is conventionally made with clear plastic material, and the box section is adhered to a support member made of paper. The Japanese Patent Laid Open No. Hei. 9-290820 discloses a conventional blister packaging made of paper.

However, the blister packaging including the box section made with clear plastic is, after removing the product, difficult to flatten; thus, it creates a high disposal volume. Furthermore, when a user tries to separate the plastic blister box from the paper support member for recycling, the plastic blister is not recycled because some part of the paper from the support member remains adhered to the plastic blister even after being separated. If the plastic blister with the attached paper is incinerated, harmful gas may be generated. On the other hand, the paper blister packaging disclosed in the Japanese Patent Application Laid Open No. Hei. 9-290820 does not have enough strength on its box section projected from a support member.

SUMMARY OF THE INVENTION

Therefore, it is an object of the present invention to provide a paper packaging which is capable of overcoming the above drawbacks accompanying the conventional art. The above and other objects can be achieved by combinations described in the independent claims. The dependent claims define further advantageous and exemplary combinations of the present invention.

According to the first aspect of the present invention, paper packaging accommodating a product comprises a support member having an opening; a box section protruding through the opening from a back side to a front side of the support member; and a backing sheet covering the back side of the support member.

The box section may include a flap around the box section for contacting with an edge of the opening when the box section is inserted to the opening. The flap may be adhered to the support member from the back side of the support member. The backing sheet may be adhered on the flap in an opposite side opposite to a side on which the support member is adhered. The box section may include a front face and a plurality of side faces, and a back face of the box section is covered with the backing sheet. The box section may accommodate a plurality of film cartridges.

The front face of the box section may include a groove facing a region between the plurality of film cartridges. The box section and the backing sheet are made from same piece of paper. The box section, the backing sheet, and the support member may be made from one piece of paper; and provided in the mentioned order on the same piece of paper. The box section may include a continuously curved surface which includes the front face and two of the side faces horizontally connecting to the front face.

According to the second aspect of the present invention, a assembling method of a paper packaging for accommodating a product, comprises preparing a support member having an opening; forming a box section; erecting the box section and protruding the box section from a back side of the support member to front side of the support member through the opening of the support member; preparing a backing sheet; and putting the backing sheet and the back side of the support member together.

The forming the box section may include forming a flap around the box section for connecting with an edge of the opening; and the erecting may include connecting the flap with the edge. The assembling method of the paper packaging may further include adhering the flap on the edge; and adhering the backing sheet on a back side of the flap.

According to the third aspect of the present invention, a packaging accommodating a product may comprise a support member having an opening; a backing sheet covering a back side of the support member; and a first box section for covering at least a part of the product to fold the product onto said support member and said backing sheet, the width of said first box section is smaller than the width of at least one of said support member and said backing sheet, and having a plurality of flaps sandwiched by said support member and said backing sheet in at least three directions of said first box section.

The packaging may further include a second box section, having a back opening and the second box section protrudes through the back opening in an opposite direction to the first box section. The packaging may be made of paper. At least the first box section may be made of plastic material.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1A:
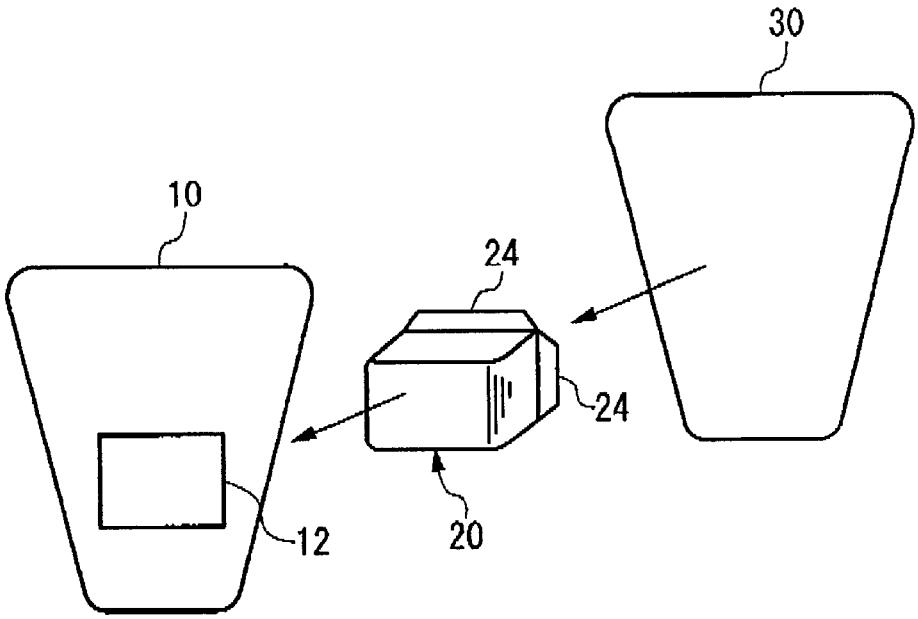
FIG. 1A shows the paper blister packaging 60 before being assembled.
Figure 1B:
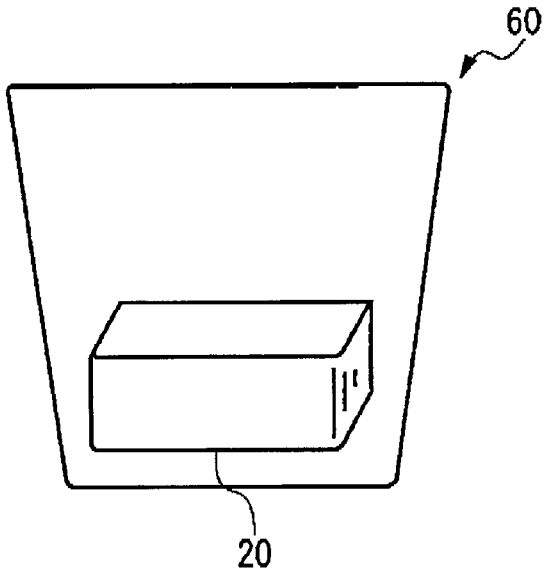
FIG. 1B is a perspective view of the paper blister packaging 60 after assembled.

FIGS. 1A and 1B are configuration figures showing a paper packaging 60 according to the embodiment of the present invention. The paper packaging 60 has a support member 10 including an opening 12, a box section 20, and a backing sheet 30. The support member 10, the box section 20, and the backing sheet 30 are entirely made from paper. FIG. 1A shows the paper blister packaging 60 before being assembled. FIG. 1B is a perspective view of the paper blister packaging 60 after being assembled. The box section 20 protrudes through the opening 12 of the support member 10 from a back side toward a front side, and the box section 20 is erect. Flaps 24 around the box section 20 contact with edges around the opening 12. Furthermore, the backing sheet 30 and the support member 10 sandwich the erected box section 20 therebetween.

Figure 2A:
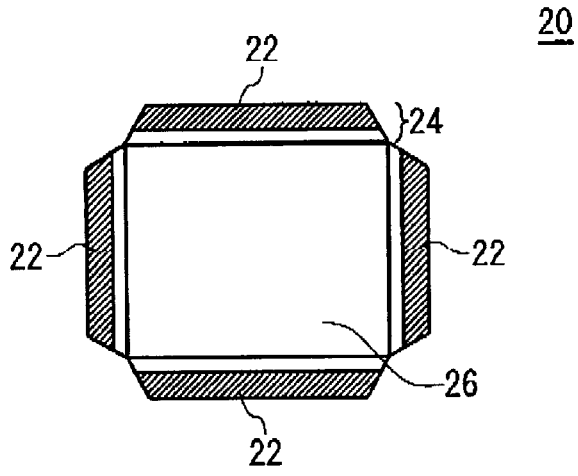
FIG. 2A shows a rear view of the box section 20.
Figure 2B:
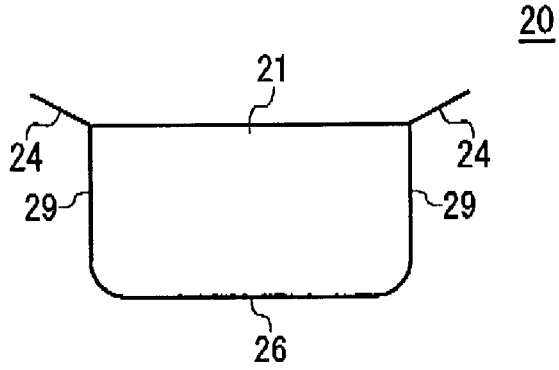
FIG. 2B shows a top view of the box section 20.
Figure 2C:
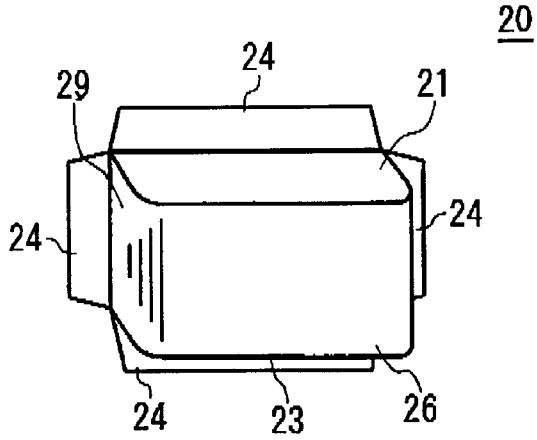
FIG. 2C is a perspective view of the box section 20 from the front side.

FIG. 2 shows an example of the box section 20 in detail. FIG. 2A shows a rear view of the box section 20. FIG. 2B shows a top view of the box section 20. FIG. 2C is a perspective view of the box section 20 from the front side. The box section 20 has a front face 26, an upper face 21, a bottom face 23, a right side face and a left side face 29, and four flaps 24. The front face 26 is connected with the right and the left side faces 29 of the box section 20; and the right side face 29, the front face 26, and the left side face 29 form a continuous curved surface. The box section 20 is formed like a box. The box section 20 has a large opening on its back face. A product to be accommodated in the box section is packed from the opening on the back face, and the opening is later covered with the backing sheet 30. For example, the box section 20 accommodates a film cartridge for photography. The box section 20 may accommodate a plurality of film cartridges. Adhering areas 22 are provided on the hatched area on each of the flaps 24. The flaps 24 are adhered to the support member 10 from the backside of the support member. The backing sheet 30 may be similarly adhered on the backside of the flaps 24. As described later in detail, the box section 20 may accommodate any kinds of products relating to camera, as because present invention primarily concerns the packaging and not the products to be accommodated therein, as clearly understood when reading the specification as a whole.

Figure 3:
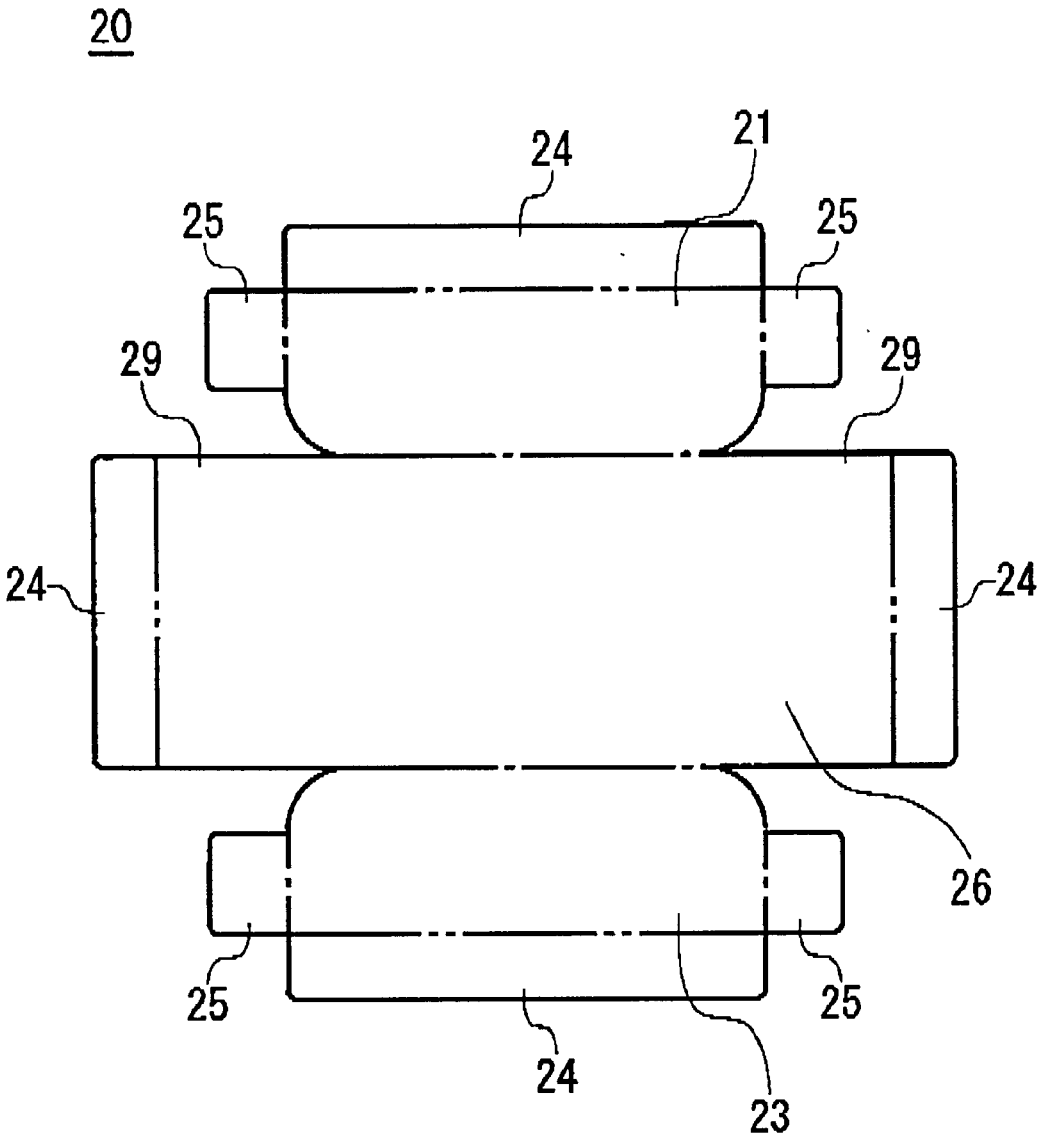
FIG. 3 shows an example of the box section before folded.

FIG. 3 shows an example of the box section 20 before being folded. A chain dashed line depicts a line to be folded in a mountain folding, whereby the two faces of the paper opposite the viewer become closer. A double dashed line depicts a line to be folded in a valley folding, whereby the two faces of the paper facing the viewer become closer. Thus, flaps 25 are folded away from the viewer whereas the flaps 24 are folded toward the viewer. The region where the front face 26 and the side faces 29 connecting one another is processed to form a smooth and continuously curved surface. If the box has a corner, the corner may be collapsed when dropped. Collapsing the corner may be avoided by forming the corner into the continuously curved surface. Furthermore, when the box section accommodates a film cartridge, the curved surface fits a curved outline of the film cartridge. Thus, wearing between an interior surface of the box section 20 and a surface of the film cartridge may be avoided. The region where the front face 26 connects the side faces 29 may form a plurality of predetermined angled ridges fitting with the outline of the product.

Figure 4A:
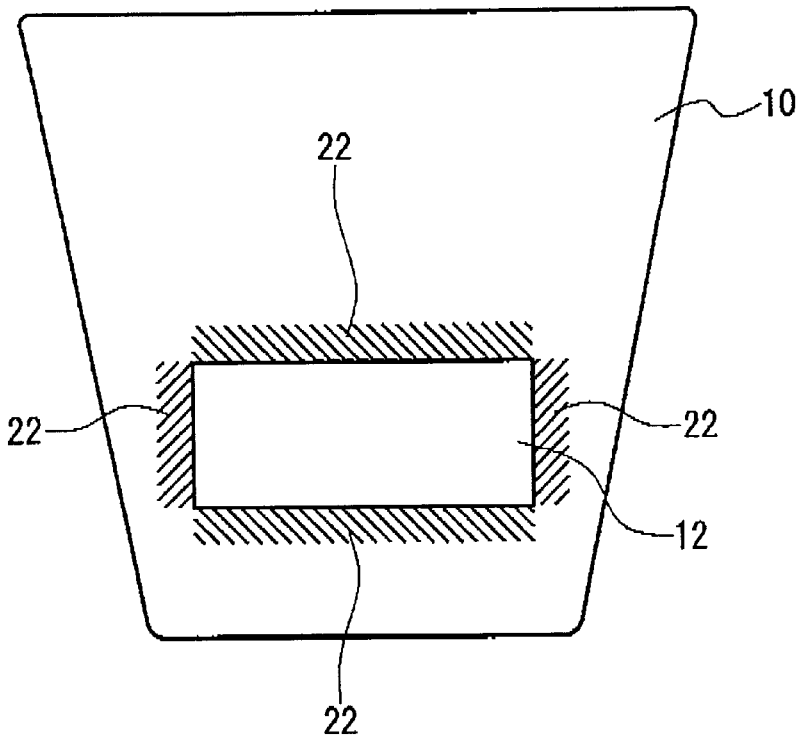
FIG. 4A shows an example of a support member and an adhering area 22.
Figure 4B:
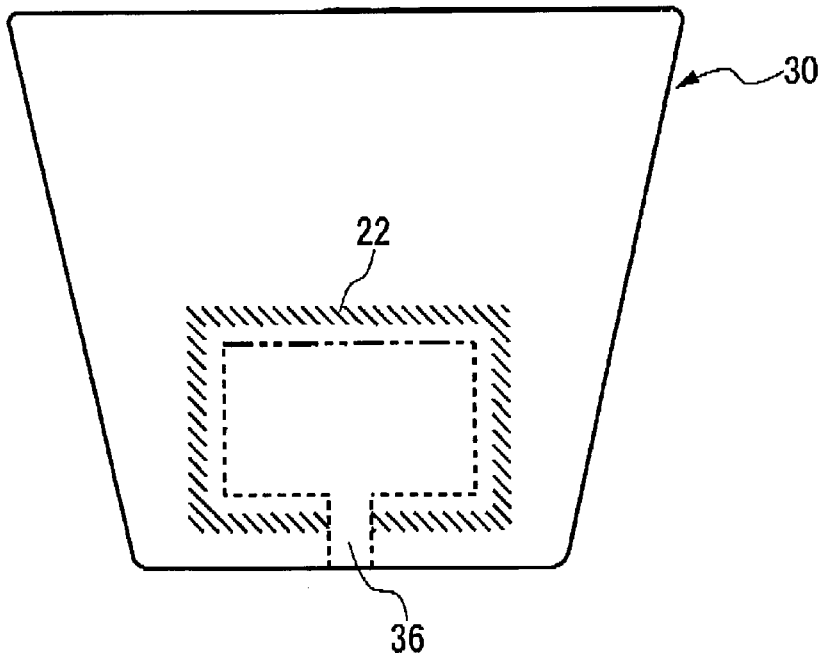
FIG. 4B shows an example of the backing sheet 30.

FIG. 4 shows a detailed example of the support member 10 and the backing sheet 30. FIG. 4A shows an example of a support member 10 and an adhering area 22. The adhering area 22, indicated as a hatched area in FIG. 4A around the opening 12 on the support member 10, contacts with the flaps 24 of the box section 20. On the adhering area 22, adhesive material maybe previously printed. FIG. 4B shows an example of the backing sheet 30. Dotted lines around the opening area 36 designate perforations, and a double-chained line depicts the line for the valley folding. Cutting the perforation around the opening area 36, a large opening is formed on the backing sheet 30 in the region being the back face of the box section 20 before cutting; and the product may be easily removed from the box section 20. It is preferable to provide the opening area 36 on the backing sheet 30; if the opening area 36 is provided on the box section 20, because the box section 20 is erect, the opening area may be possibly dropped and damaged while distributed. The hatched area around the opening area 36 contacts with the flaps 24 around the box section 20. Adhesive material may be previously printed on an adhering area 22. In some cases, the flaps 24 may be adhered to at least one of the support member 10 and the backing sheet 30. Moreover, the flaps 24 may be adhered to both the support member 10 and the backing sheet 30. In such a case, the erecting box section 20 is stably fastened against both the support member 10 and the backing sheet 30 by the flaps 24, therefore the strength of the box section 20 increases. Furthermore, the four corners of the box section 20 are surrounded by the region where the support member 10, the flaps 24, and the backing sheet 30 overlaps one another, so that the box section 20 has more strength; therefore even if the paper packaging 60 is dropped, the product accommodated in the box section 20 is protected from the shock of being dropped. In another case, the support member 10 may be put together with at least a part of the backing sheet 30 and adhered to each other. In yet another case, the flaps 24 of the box section 20 may be simply sandwiched by, but not adhered to, both the support member 10 and the backing sheet 30; and the support member 10 and the backing sheet 30 are adhered to one another.

Figure 5:
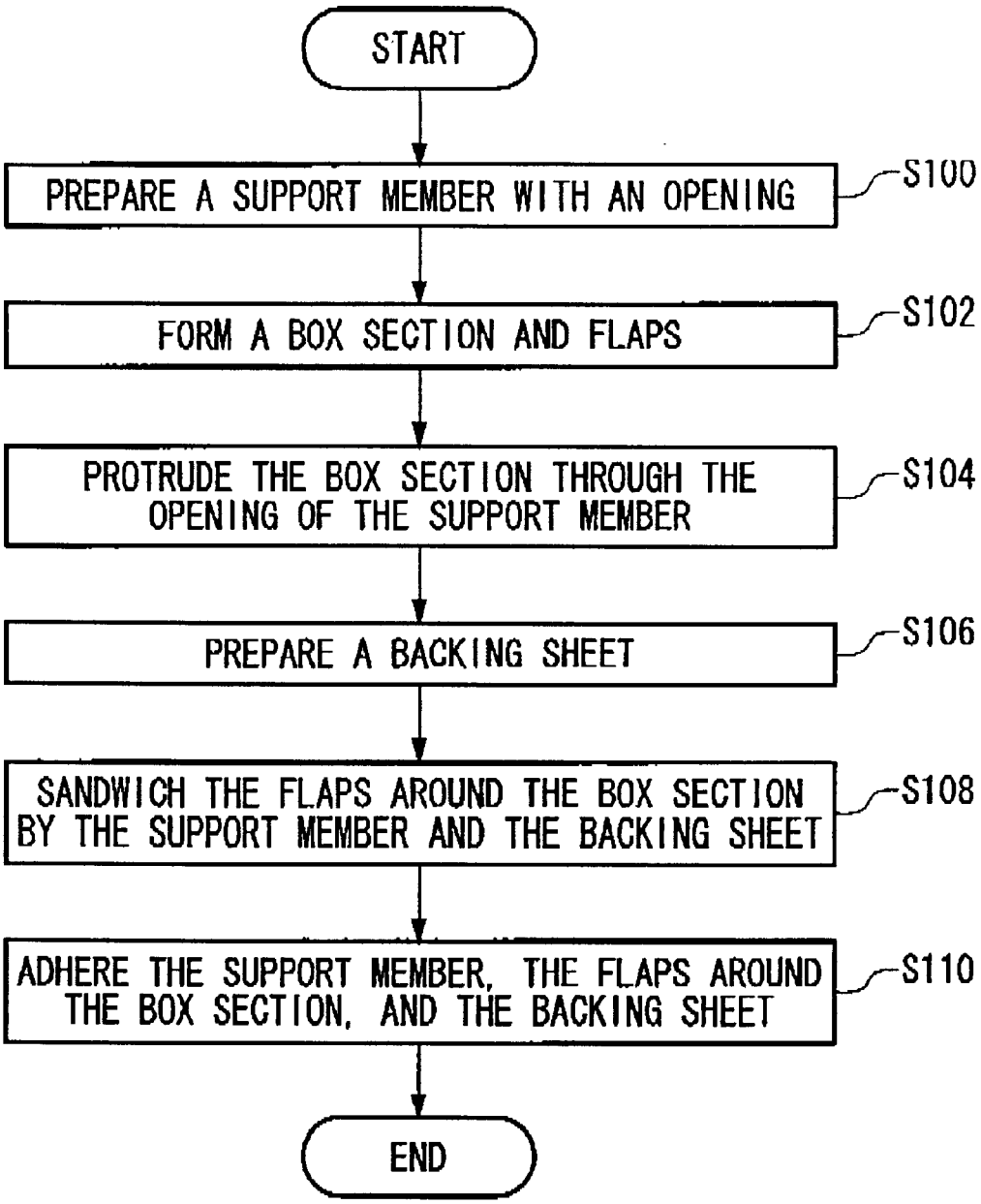
FIG. 5 is a flow chart showing a assembling method of the paper packaging.

FIG. 5 is a flow chart showing an assembling method of the paper packaging 60. A piece of cardboard is stamped out for preparing the support member 10 including the opening 12. On a surface of the support member 10, information such as a name of the product, advertising, and so on may be previously printed (S100). Another piece of cardboard is stamped out for preparing the box section 20, and folded to form the box section 20. The cardboard may also be printed with information. The flaps 24 are formed around the box section 20 (S102). The box section 20 is protruded through the opening 12 from the back side of the support member 10. The flaps 24 contact with an edge of the opening 12. The box section 20 may accommodate the product in the present step (S104). Next, yet another piece of cardboard is stamped out for preparing the backing sheet 30. The cardboard may also be printed with information (S106). On the back side of the support member 10, on which the flaps of the box section 20 are attached, the backing sheet 30 is applied (S108), so that the box section 20 is sandwiched by the support member 10 and the backing sheet 30. The edge of the opening 12 on the support member 10 is connected with the flaps 24. The back sides of the flaps 24 may be adhered with the backing sheet 30. The support member 10 may be adhered with the backing sheet 30 (S110).

Figure 6A:
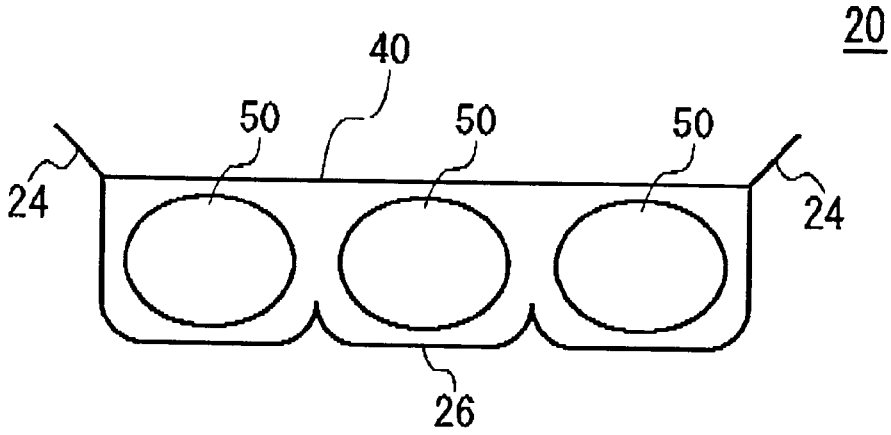
FIG. 6A shows a top view of another example of the box section 20.
Figure 6B:
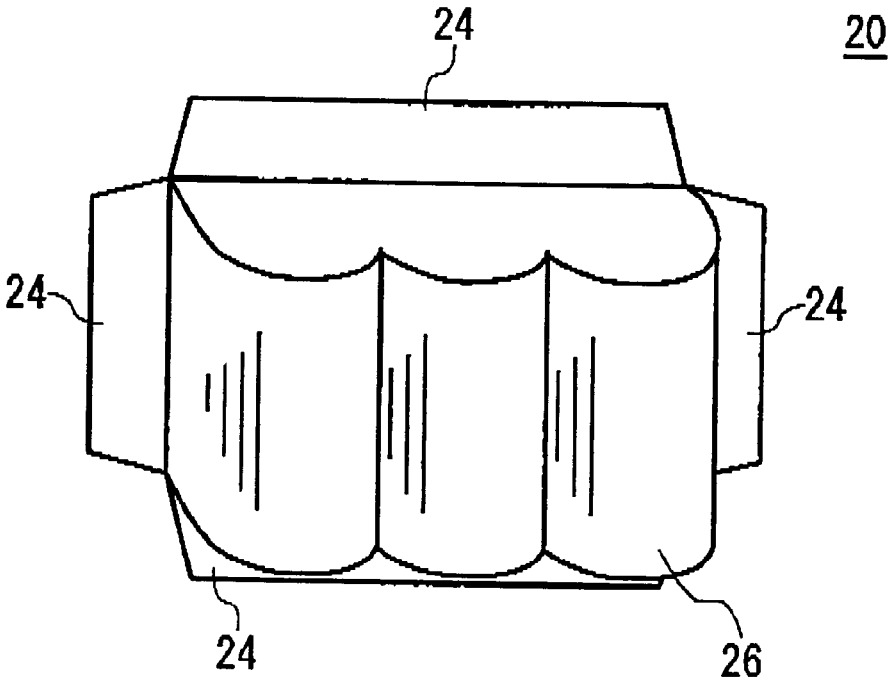
FIG. 6B is a perspective view of the box section 20 from the front side.

FIG. 6 shows another example of the box section 20 having a plurality of grooves provided in the front face 26. In the present example, the packaging accommodates a plurality of film cartridges. The front face 26 includes a groove formed in front of the region between the plurality of film cartridges 50. FIG. 6A shows a top view of another example of the box section 20. As shown in FIG. 6A, the film cartridge 50 is fastened by the groove in the box section 20. Thus, while being distributed, the film cartridges 50 are protected from being damaged by hitting one another or scraping the surface of the film cartridges 50 with an interior of the paper packaging 60. FIG. 6B is a perspective view of the box section 20 from the front side. The packaging with compartments divided by the grooves indicates to users that the film cartridges 50 are accommodated in the paper packaging 60.

Figure 7:
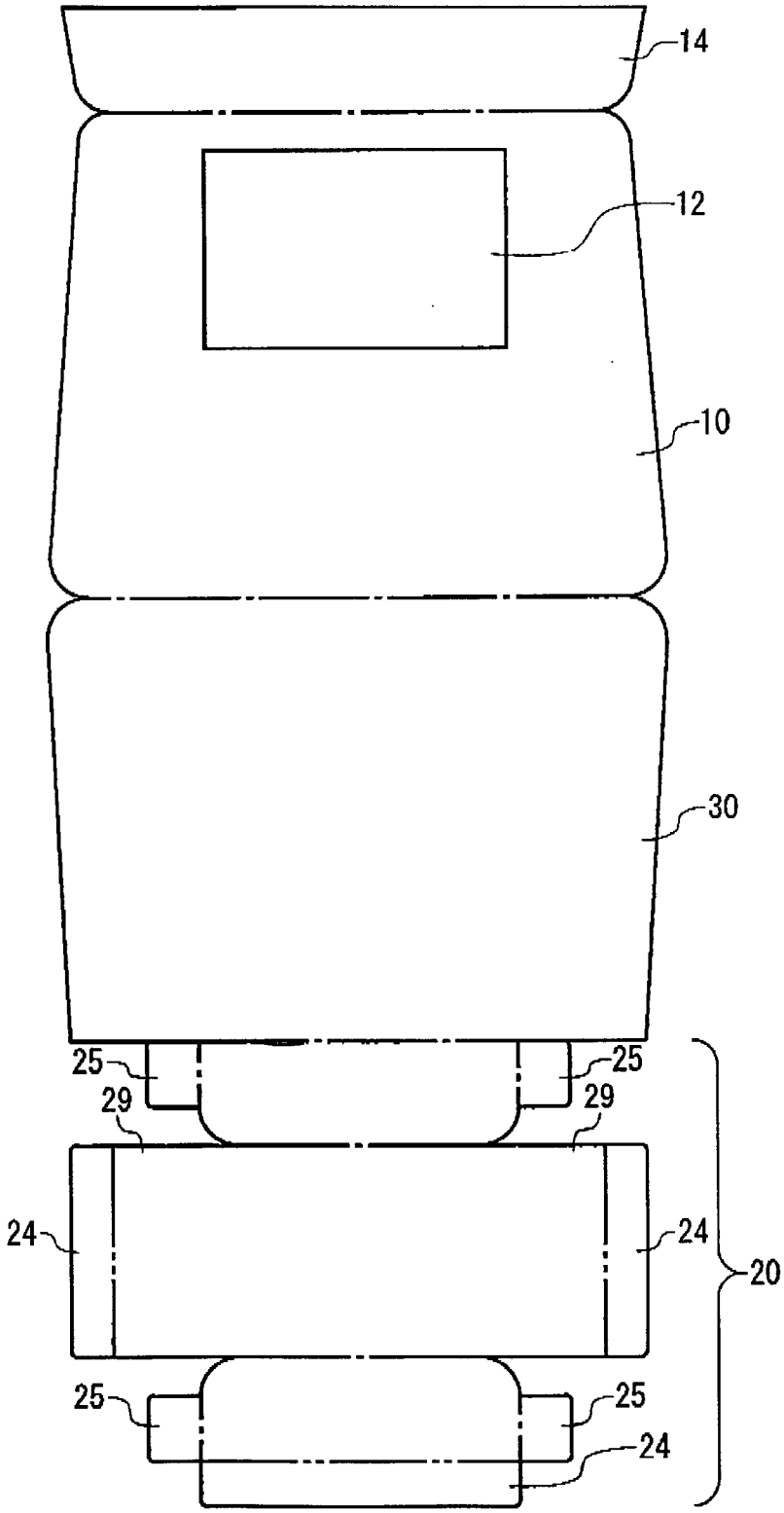
FIG. 7 shows another example of the paper packaging before folded having the support member, the box section, and the backing sheet being made from one piece of paper.

FIG. 7 shows another example of the paper packaging 60 before folded. The support member 10, the box section 20, and the backing sheet 30 are made from one piece of paper in the present example. The box section 20, the backing sheet 30, and the support member 10 are provided in the mentioned order on the aforementioned one piece of paper. For modification, the box section 20 and the backing sheet 30 may be provided on the same piece of the paper; only the support member 10 is provided separately. The chain dashed line depicts a line to be folded in a mountain folding, whereby the two faces of the paper opposite the viewer become closer. The double dashed line depicts a line to be folded in a valley folding, whereby the two faces of the paper facing the viewer become closer. The box section 20 is then folded to form the box.

Figure 8:
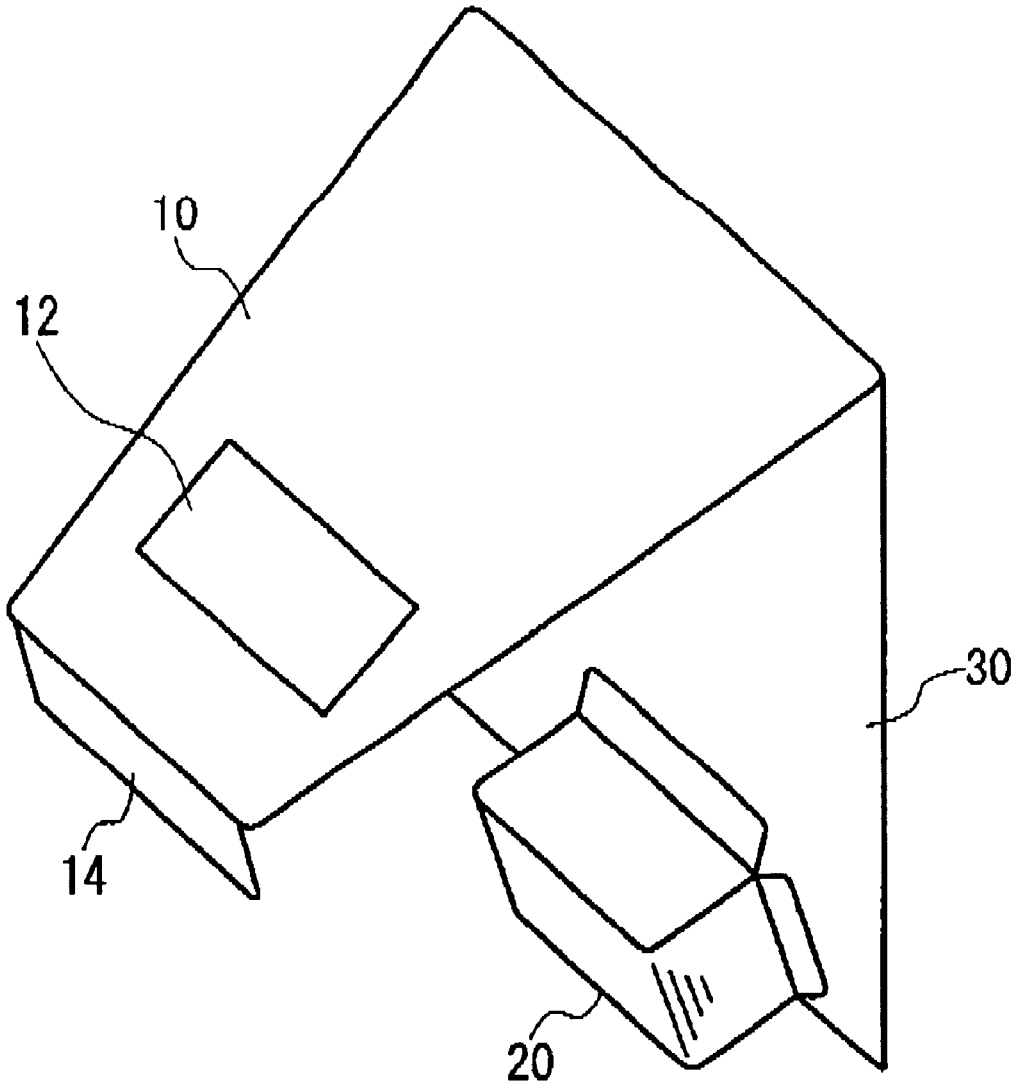
FIG. 8 shows another example of the paper packaging after being half constructed.

FIG. 8 shows another example of the paper packaging after being half constructed. The support member 10, the box section 20, and the backing sheet 30 made from one piece of paper is halfway constructed in this example. The box section 20 is placed through the opening 12 on the support member 10. The support member 10 and the backing sheet 30 are folded, put together, and used to sandwich the box section 20. A back supporting piece 14 is further folded, and connected to the backing sheet 30. The back supporting piece 14 reinforces a lower edge of the paper packaging 60 by doubling the thickness of the lower edge. Applying this modification, the paper packaging is made from only one component, so that the packaging may be both efficiently and quickly produced. Furthermore, the support member 10, the box section 20, and the backing sheet 30 are previously connected, and the adhered region may be narrowed without impairing strength. The packaging applying the present modification may be folded again after opening. After the film cartridge is removed from the paper packaging 60 and photographs are taken on it, the paper packaging 60 may re-accommodate the film cartridge.

In another modification of the present embodiment, at least the box section 20 may be made of plastic material. In the present modification, the box section 20 may be simply sandwiched by, but not adhered to, the support member 10 and the backing sheet 30. Thus, no paper is attached to the box section 20 after the accommodated product is removed; therefore the packaging is more suitable for recycling than conventional blister packaging.

According to the embodiment of the present invention, without impairing the eye-catching ability of a conventional blister pack, a strong paper blister pack that is highly suitable for recycling is produced. The main material is limited to paper; therefore the assembling apparatus is limited to paper-processing apparatus. When the box section is made of paper, the box section may be flattened by hand after the product is removed. Thus, the paper packaging after use may be entirely flattened and its volume reduced. The paper packaging after use may be conveniently recycled. The paper packaging is suitable for both recycling and incineration because the packaging leaves no mixed material after use. Therefore the paper packaging has a lower environmental impact than the conventional blister pack.

When the paper packaging applying the present embodiment accommodates the film cartridges for photography, the film cartridge for photography is sealed in a moisture barrier material packaging such as an aluminum evaporated plastic film packaging, then accommodated in the paper packaging according to the present embodiment. The moisture barrier material may be incinerated without generating harmful gas when proper material is selected. When the moisture barrier packaging of the film cartridge for photography is provided as described above, the entire packaging, including both the paper packaging and the aluminum evaporated film packaging is suitable for incineration.

A hatching applied on the side face 24 of the box section 20 or the curved surface including the front face 26 and the side faces 29 in FIG. 1A and FIG. 1B, FIG. 2C, FIG. 6B, and FIG. 8 is applied for stereoscopic effect.

Although the present invention has been described by way of exemplary embodiments, it should be understood that those skilled in the art might make many changes and substitutions without departing from the spirit and the scope of the present invention which is defined only by the appended claims.

For example, though the present embodiments refer the film cartridges for photography that are accommodated in the box section of the packaging. However, it is not limited thereto or thereby. According to the present invention, the box section may accommodate any product relating to camera such as, a camera body itself including permanent or disposable camera, a stack of photo papers, photo albums, bottles for photo developer, recording medium such as memory, optical disk, magnetic disk, magnetic tape and smart medium, camera accessories such as casing, strap, application software, PC card adopter, battery charger, flush pass, image card reader, battery with or without charger, consumables for printer, word processor or copying machine such as ink cartridge, ink ribbon, seal sheets. The camera may include any digital or analog camera, still or movie camera. Further, the film cartridges embodied in the present specification may also include various kinds of films such as, for example, for APS, 135 film, 110 film, 220 film, instant film or other cut film. As is apparent above, the present invention primally concerns a packaging and not the product to be accommodated therein, and any products relating to camera may be accommodated by the box section of the packaging according to the present invention.

What is claimed is:

1. A paper packaging accommodating a product relating to photographs, comprising:

a support member having an opening;

a backing sheet covering a back side of said support member;

a box section protruding through said opening from said back side to a front side of said support member, said box section having a plurality of flaps extending from said box section, at least one of said flaps adhered to at least one of said support member and said backing sheet, said box section having a front face and a plurality of side faces, and having a continuously curved surface which includes said front face and two of said side faces horizontally connecting to said front face, said box section being independent from said support member and said backing sheet; and wherein said support member, said backing sheet and said box section are constituted of paper.

2. A paper packaging according to claim 1, wherein said front face of said box section has a flat face which is substantially parallel to said support member.

3. A paper packaging according to claim 1, wherein adhesive material is pre-printed on said flaps.

4. A paper packaging according to claim 3, wherein said flaps are adhered to both of said support member and said backing sheet.

5. A paper packaging according to claim 1, wherein said box section accommodates at least one film cartridge for photographs.

6. A paper packaging according to claim 1, wherein said support member and said backing sheet have a tapered shape.

7. A paper packaging accommodating a product, comprising:

a support member having an opening;

a backing sheet covering a back side of said support member, said backing sheet comprising an opening area surrounded at least in part by perforations;

a box section protruding through said opening from said back side to a front side of said support member, said box section having a plurality of flaps extending from said box section, at least one of said flaps adhered to at least one of said support member and said backing sheet, said box section being independent from said support member and said backing sheet; and wherein said support member, said backing sheet and said box section are constituted of paper.

8. A paper packaging according to claim 7, wherein said box section comprises a front flat face which is substantially parallel to said support member.

9. A paper packaging according to claim 7, wherein adhesive material is pre-printed on said flaps.

10. A paper packaging according to claim 7, wherein said flaps are adhered to both of said support member and said backing sheet.

11. A paper packaging according to claim 7, wherein a part of said opening area of said backing sheet is surrounded by a valley folding.

12. A paper packaging according to claim 11, wherein said opening area comprises a first large part and a second small part connected to said first part, and a part of said first part is surrounded by said valley folding.

13. A paper packaging accommodating a product relating to photography, comprising:

a support member having an opening;

a backing sheet covering a back side of said support member;

a box section protruding through said opening from said back side to a front side of said support member, said box section having a plurality of flaps extending from said box section, at least one of said flaps adhered to at least one of said support member and said backing sheet, said box section having a front face and a plurality of side faces, and also having a continuously curved surface which includes said front face and two of said side faces horizontally connected to said front face; and wherein said support member, said backing sheet and said box section are made from one piece of paper.

14. A paper packaging according to claim 13, wherein said front face of said box section has a flat face which is substantially parallel to said support member.

15. A paper packaging according to claim 14, wherein adhesive material is pre-printed on said flaps.

16. A paper packaging according to claim 13, wherein said flaps are adhered to both of said support member and said backing sheet.

17. A paper packaging according to claim 13, further comprising a back supporting piece connected to an edge of said support member, said back supporting piece being folded and connected to said backing sheet.

18. A paper packaging according to claim 13, wherein said box section accommodates at least one film cartridge for photographs.

19. A paper packaging according to claim 13, wherein said support member and said backing sheet have a tapered shape.

20. A paper packaging accommodating a product, comprising:

a support member having an opening;

a backing sheet covering a back side of said support member, said backing sheet comprising an opening area surrounded at least in part by perforations;

a box section protruding through said opening from said back side to a front side of said support member, said box section having a plurality of flaps extending from said box section, at least one of said flaps is adhered to at least one of said support member and said backing sheet; and wherein said support member, said backing sheet and said box section are made of one piece of paper.

21. A paper packaging according to claim 20, wherein said box section comprises a front flat face which is substantially parallel to said support member.

22. A paper packaging according to claim 20, wherein adhesive material is pre-printed on said flaps.

23. A paper packaging according to claim 20, wherein said flaps are adhered to both of said support member and said backing sheet.

24. A paper packaging according to claim 20, further comprising a back supporting piece connected to an edge of said support member, said back supporting piece being folded and connected to said backing sheet.

25. A paper packaging according to claim 20, wherein a part of said opening area of said backing sheet is surrounded by a valley folding.

26. A paper packaging according to claim 25, wherein said opening area comprises a first large part and a second small part connecting to said first large part, and a part of said first large part is surrounded by said valley folding.

27. An assembling method of a paper packaging for accommodating a product relating to photographs, comprising:

preparing a support member, constituted of paper, and comprising an opening;

preparing a backing sheet constituted of paper;

forming a box section having a plurality of flaps extending from said box section and a front face and a plurality of side faces thereof, said box section being independent from said support member and said backing sheet;

forming on said box section a continuously curved surface which includes said front face and two of said side faces horizontally connecting to said front face;

erecting said box section and protruding said box section from a back side of said support member to a front side of said support member through said opening of said support member;

putting said backing sheet and said back side of said support member together; and adhering at least one of said flaps to at least one of said support member and said backing sheet.

28. The assembling method of the paper packaging as claimed in claim 27, further comprising a step of forming perforations and valley folding on said backing sheet to define an opening area.

29. A method of assembling a paper packaging for accommodating a product relating to photography, comprising:

preparing one piece of paper;

forming a support member comprising an opening on said one piece of paper;

forming a backing sheet comprising an opening on said one piece of paper;

forming, on said one piece of paper, a box section having a plurality of flaps extending from said box section and a front face and a plurality of side faces;

forming on said box section a continuously curved surface which includes said front face and two of said side faces horizontally connecting to said front face;

erecting said box section and protruding said box section from a back side of said support member to a front side of said support member through said opening of said support member;

positioning said backing sheet and said back side of said support member together, and adhering at least one of said flaps to at least one of said support member and said backing sheet.

30. The method of assembling the paper packaging as claimed in claim 29, further comprising a step of forming perforations and valley folding on said backing sheet to define an opening area.

* * * * *